US007044242B2

(12) United States Patent
Miglierini et al.

(10) Patent No.: US 7,044,242 B2
(45) Date of Patent: May 16, 2006

(54) ROLLER CONE BITS WITH REDUCED PACKING

(75) Inventors: Raul A. Miglierini, Dallas, TX (US); Andrew J. Osborne, Jr., Dallas, TX (US)

(73) Assignee: Halliburton Energy Services, Inc., Carrollton, TX (US)

( * ) Notice: Subject to any disclaimer, the term of this patent is extended or adjusted under 35 U.S.C. 154(b) by 0 days.

(21) Appl. No.: 10/133,214

(22) Filed: Apr. 26, 2002

(65) Prior Publication Data

US 2003/0042049 A1 Mar. 6, 2003

Related U.S. Application Data

(60) Provisional application No. 60/287,086, filed on Apr. 26, 2001, provisional application No. 60/287,164, filed on Apr. 27, 2001.

(51) Int. Cl.
*E21B 10/22* (2006.01)
*E21B 12/06* (2006.01)

(52) U.S. Cl. ..... 175/313; 175/371; 384/92

(58) Field of Classification Search ..... 175/371, 175/372, 331, 359, 313, 339; 384/92, 94, 384/95

See application file for complete search history.

(56) References Cited

U.S. PATENT DOCUMENTS 1,641,261 A 9/1927 Fletcher
2,041,467 A 5/1936 Green
2,296,939 A 9/1942 McMahan
2,560,328 A 7/1951 Bielstein
2,582,312 A 1/1952 Del' Homme
2,769,616 A 11/1956 Morlan
2,797,067 A 6/1957 Fisher
2,814,464 A 11/1957 Pike
2,960,313 A 11/1960 Goodwin
3,011,566 A 12/1961 Graham
3,013,621 A 12/1961 Kinnear
3,058,532 A 10/1962 Alder
3,062,302 A 11/1962 Toth et al.
3,193,028 A * 7/1965 Radzimovsky ..... 175/372
3,363,702 A 1/1968 Bielstein
3,578,092 A 5/1971 Tesch
3,581,564 A 6/1971 Young, Jr.
3,656,764 A 4/1972 Robinson
3,678,883 A 7/1972 Fischer
3,703,096 A 11/1972 Vitter, Jr. et al.
3,714,822 A 2/1973 Lutz
3,728,919 A 4/1973 Scott
3,774,445 A 11/1973 Rundell et al.

(Continued)

OTHER PUBLICATIONS

Hughes Christensen, Ultra Max High Performance Bits For Motor and High Speed Applications, 1998, p. 3.*

*Primary Examiner*—David Bagnell
*Assistant Examiner*—Shane Bomar
(74) *Attorney, Agent, or Firm*—Groover & Holmes; Robert O. Groover; Patric C. R. Holmes

(57) ABSTRACT

A roller-cone drill bit in which a large groove is machined into the backface of each cone, near the crack where the cone meets the arm assembly. By making the outer lip of this crack more exposed to the open volume of turbulent flow, turbulence near the crack is increased, deposit of sediments near the crack is reduced, and infiltration of sediments through the crack is also reduced.

31 Claims, 18 Drawing Sheets

U.S. PATENT DOCUMENTS 3,782,190 A 1/1974 Pittman
3,818,227 A 6/1974 Fries
3,853,087 A 12/1974 Aldag
3,853,184 A 12/1974 McCullough
3,862,762 A 1/1975 Millsap
3,865,736 A 2/1975 Fries
3,906,434 A 9/1975 Lemel et al.
3,913,686 A 10/1975 Manson, Jr.
3,921,735 A 11/1975 Dysart
4,001,773 A 1/1977 Lamel et al.
4,030,558 A 6/1977 Morris
4,040,003 A 8/1977 Beynet et al.
4,063,786 A 12/1977 Rall
4,074,575 A 2/1978 Bergman et al.
4,114,704 A 9/1978 Maurer et al.
4,148,271 A 4/1979 Majernik
4,150,568 A 4/1979 Berger et al.
4,156,470 A 5/1979 Bodine
4,176,848 A 12/1979 Lafuze
4,183,417 A 1/1980 Levefelt
4,200,343 A 4/1980 Highsmith
4,223,749 A 9/1980 Bodine
4,346,591 A 8/1982 Evans
4,375,242 A 3/1983 Galle
4,379,291 A 4/1983 Hubbard et al.
4,431,066 A 2/1984 Cunningham et al.
4,436,164 A 3/1984 Garner
4,437,774 A * 3/1984 Schultz ..... 384/92
4,446,933 A 5/1984 Bodine
4,478,299 A 10/1984 Dorosz
4,515,228 A * 5/1985 Dolezal et al. ..... 175/313
4,610,452 A * 9/1986 DiRienz ..... 175/371
4,629,338 A 12/1986 Ippolito
4,655,300 A 4/1987 Davis et al.
4,688,651 A 8/1987 Dysart
4,722,404 A * 2/1988 Evans ..... 175/371
4,730,681 A 3/1988 Estes
4,762,189 A 8/1988 Tatum
4,785,894 A 11/1988 Davis et al.
4,785,895 A 11/1988 Davis et al.
4,822,057 A 4/1989 Chia et al.
4,911,252 A 3/1990 Estes
5,056,610 A * 10/1991 Oliver et al. ..... 175/371
5,080,183 A 1/1992 Schumacher et al.
5,358,061 A * 10/1994 Van Nguyen ..... 175/371
5,360,076 A 11/1994 Kelly, Jr.
5,452,771 A * 9/1995 Blackman et al. ..... 175/353
5,472,058 A 12/1995 Hooper
5,570,750 A 11/1996 Williams
5,740,871 A 4/1998 Williams
6,026,917 A * 2/2000 Zahradnik et al. ..... 175/371
6,033,117 A * 3/2000 Cariveau et al. ..... 384/94
6,056,072 A * 5/2000 Koltermann et al. ..... 175/227
6,142,249 A 11/2000 Zahradnik
6,254,275 B1 * 7/2001 Slaughter et al. ..... 384/92
6,264,367 B1 7/2001 Slaughter, Jr.
6,336,512 B1 * 1/2002 Siracki et al. ..... 175/371
6,450,271 B1 * 9/2002 Tibbitts et al. ..... 175/374
6,533,051 B1 * 3/2003 Singh et al. ..... 175/371
6,631,772 B1 10/2003 Palaschenko
6,634,441 B1 10/2003 Palaschenko
6,725,947 B1 4/2004 Palaschenko et al.
2003/0029645 A1 2/2003 Mourik

* cited by examiner

ROLLER CONE BITS WITH REDUCED PACKING

CROSS-REFERENCE TO OTHER APPLICATIONS

This application claims priority from U.S. provisional applications 60/287,086 filed Apr. 26, 2001 and 60/287,164 filed Apr. 27, 2001, both of which are hereby incorporated by reference.

BACKGROUND AND SUMMARY OF THE INVENTION

The present invention relates to roller cone drill bits, and particularly to their sealing structures.

Oil wells and gas wells are drilled by a process of rotary drilling. In conventional vertical drilling (as shown in FIG. 4). a drill bit 10 is mounted on the end of a drill string (drill pipe plus drill collars), which may be miles long, while at the surface a rotary drive turns the drill string, including the bit at the bottom of the hole.

When the bit wears out or breaks during drilling, it must be brought up out of the hole. This requires a process called "tripping": a heavy hoist pulls the entire drill string out of the hole, in stages of (for example) about ninety feet at a time. After each stage of lifting, one "stand" of pipe is unscrewed and laid aside for reassembly (while the weight of the drill string is temporarily supported by another mechanism). Since the total weight of the drill string may be hundreds of tons, and the length of the drill string may be many thousands of feet, this is not a trivial job. One trip can require tens of hours and is a significant expense in the drilling budget. To resume drilling the entire process must be reversed. Thus the bit's durability is very important, to minimize round trips for bit replacement during drilling.

Two main types of drill bits are in use, one being the roller cone bit. FIG. 3 shows an example of a complete bit (of the insert type), in which a set of rotary cones 302, each having many teeth or cutting inserts 304, are each mounted on rugged bearings on an arm 310. The bit's teeth must crush or cut rock, with the necessary forces supplied by the "weight on bit" (WOB) which presses the bit down into the rock, and by the torque applied at the rotary drive. While the WOB may in some cases be 100,000 pounds or more, the forces actually seen at the drill bit are not constant: the rock being cut may have harder and softer portions (and may break unevenly), and the drill string itself can oscillate in many different modes. Thus the drill bit must be able to operate for long periods under high and variable stresses in a remote environment.

As the drill bit rotates, the roller cones roll on the bottom of the hole. The weight-on-bit forces the downward pointing teeth of the rotating cones into the formation being drilled, applying a compressive stress which exceeds the yield stress of the formation, and thus inducing fractures. The resulting fragments are flushed away from the cutting face by a high flow of drilling fluid.

During drilling operations, drilling fluid, commonly referred to as "mud", is pumped down through the drill string and out through the drill bit. The flow of the mud is one of the most important factors in the operation of the drill bit, serving both to remove the cuttings which are sheared from rock formations by the drill bit and also to cool the drill bit and teeth (as well as other functions). However, the fragments of rock in the mud (which are constantly being released at the cutting face) make the mud a very abrasive fluid.

FIG. 5 is a sectional view of the internal surfaces of a prior art cone; cylindrical surfaces 11 and 13 are two journal bearings, while bearing race 15 holds ball bearings which control the axial position of the cone. A seal gland 17 holds an elastomer seal.

At least one seal is normally designed into the arm/cone joint, to exclude the abrasive cuttings-laden mud from the bearings. When this seal fails, the abrasive cuttings-laden mud will very rapidly destroy the bearings. Thus the seal is a very critical factor in bit lifetime, and may indeed be the determining factor.

The special demands of sealing the bearings of roller cone bits are particularly difficult. The drill bit is operating in an environment where the turbulent flow of drilling fluid, which is loaded with particulates of crushed rock, is being driven by hundreds of pump horsepower. The flow of mud from the drill string may also carry entrained abrasive fines. The mechanical structure around the seal is normally designed to limit direct impingement of high-velocity fluid flows on the seal itself, but some abrasive particulates will inevitably migrate into the seal location. Particles of abrasive materials (fines and sediments) will tend to accumulate as an abrasive mass at the edge of the O-ring. (This phenomenon is referred to as "packing.") This abrasive mass will abrade the O-ring-type seal, until it eventually reduces the sealing area of the O-ring seal and causes failure. Additional general information regarding seals can be found in Leonard J. Martini, Practical Seal Design, (1984) and in Seals and Sealing Handbook (4.ed. M. Brown 1995), both of which are hereby incorporated by reference.

Some prior attempts have been made to reduce particulate incursion. Baker-Hughes bits are believed to have used a small mud wiper in combination with a small groove in the cone backface. Smith bits are believed to have used a "shale burn" insert which laterally diverts cutting pieces away from the dynamic crack.

ROLLER CONE BITS WITH REDUCED PACKING

The present inventors have discovered a new way to reduce packing in the seal gland, and thereby greatly extend seal life. The crack between arm and cone (i.e. the region of closest fit, outboard of the seal location, where a dynamic interface exists between arm and cone) terminates with a more sudden widening than has been used in the prior art. This sudden widening has dramatic benefits in reducing sedimentation. Preferably this widening is at least partly provided by a groove in the backface of the cone, which has a large enough cross-section to allow high turbulent flow velocities within it.

Preferably (in at least some embodiments) the groove is ridged, i.e. has a rim which only partly separates it from the turbulent free-flowing mud.

Preferably (in at least some embodiments) a finger, fixed to the arm, protrudes into the groove.

In at least some embodiments, the end of the crack, as seen in section normal to the crack, opens up at an angle of 180 degrees or more.

The disclosed inventions have been shown to provide dramatically longer seal life, and hence longer bit life.

A further benefit is improved cooling. The disclosed inventions lessen the distance between the seal and high-velocity mud flow, and thus improve cooling at the seal.

Note that these benefits result from a surprising function: some prior art attempted to wipe away particulates near the dynamic crack, but no known prior art has used fluid dynamics, as disclosed herein, to increase peak fluid velocity at the opening of the dynamic crack.

BRIEF DESCRIPTION OF THE DRAWING

The disclosed inventions will be described with reference to the accompanying drawings, which show important sample embodiments of the invention and which are incorporated in the specification hereof by reference, wherein.

DETAILED DESCRIPTION OF THE PREFERRED EMBODIMENTS

The numerous innovative teachings of the present application will be described with particular reference to the presently preferred embodiment (by way of example, and not of limitation).

Figure 1:
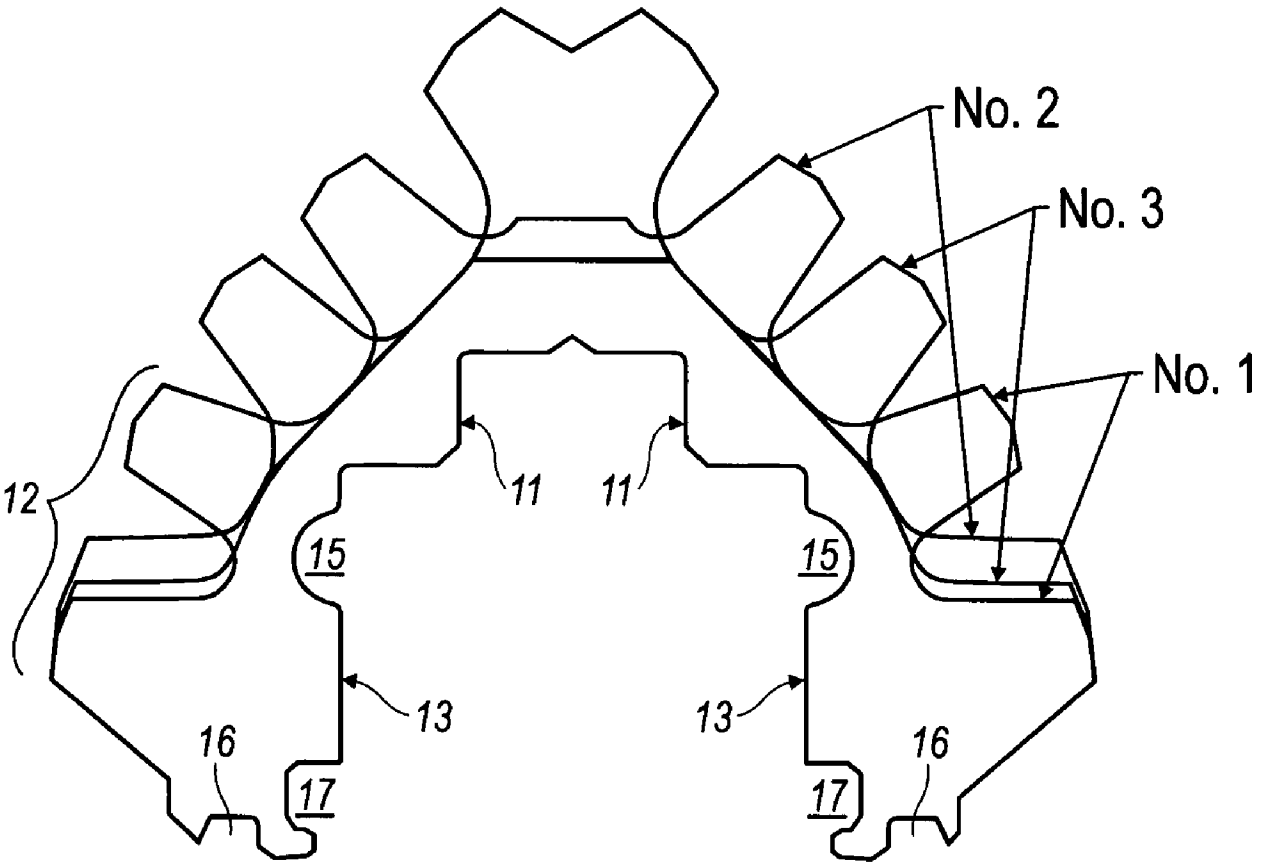
FIG. 1 shows two sample embodiments of drill bit cones with milled teeth demonstrating the innovative groove. (Note that the right and left sides of this figure show two different embodiments.)

FIG. 1 shows drill bit cone 10 with milled teeth demonstrating the innovative groove. The drawing is an overlay, showing the location of teeth 12 for each of the three cones (i.e., No. 1, No. 2, and No. 3) of a tri-cone bit, showing how the teeth are positioned. The inner surface of the cone 10 is shaped to form journal bearings at 11 and 13, to allow room for roller bearings at 15 and to provide a gland 17 for the elastomeric seal. (All these are typical of roller cone bit, although their exact dimensions may vary from bit to bit.) On the bottom of the cone (as seen in the drawing) is the innovative groove 16, whose use has prolonged the life of the bit considerably.

Figure 2:
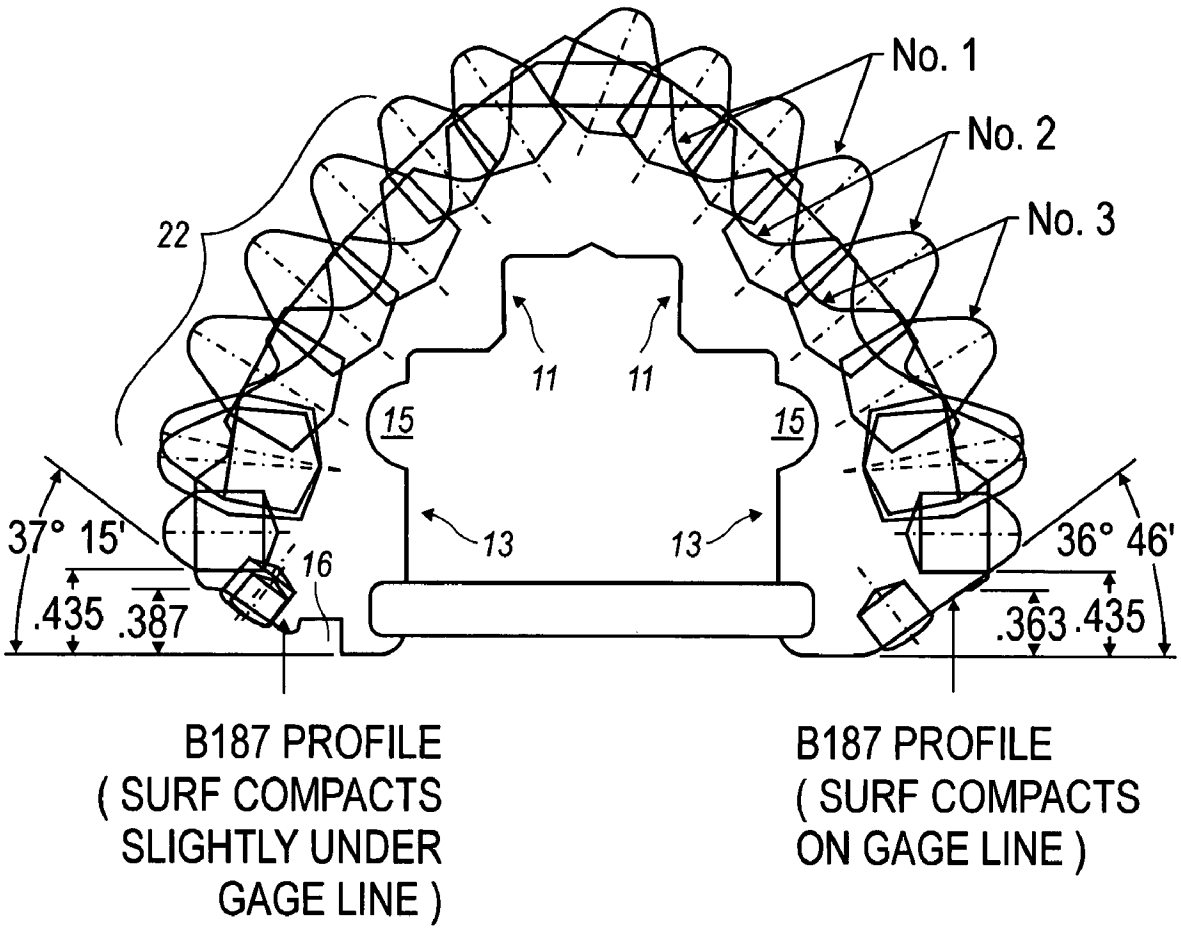
FIG. 2 shows two sample embodiments of insert cones demonstrating the innovative groove.
Figure 3:
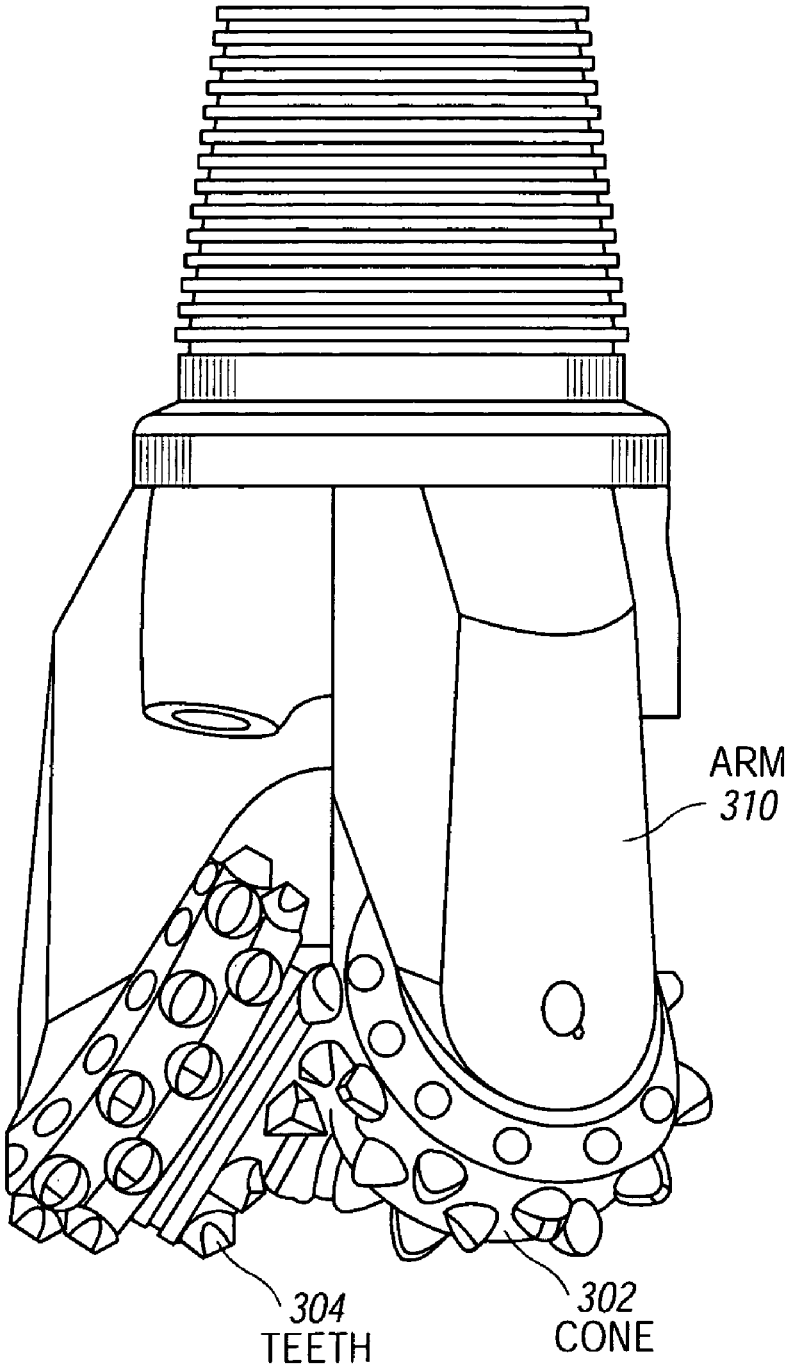
FIG. 3 is a view of an exemplary rotary cone drill bit.
Figure 4:
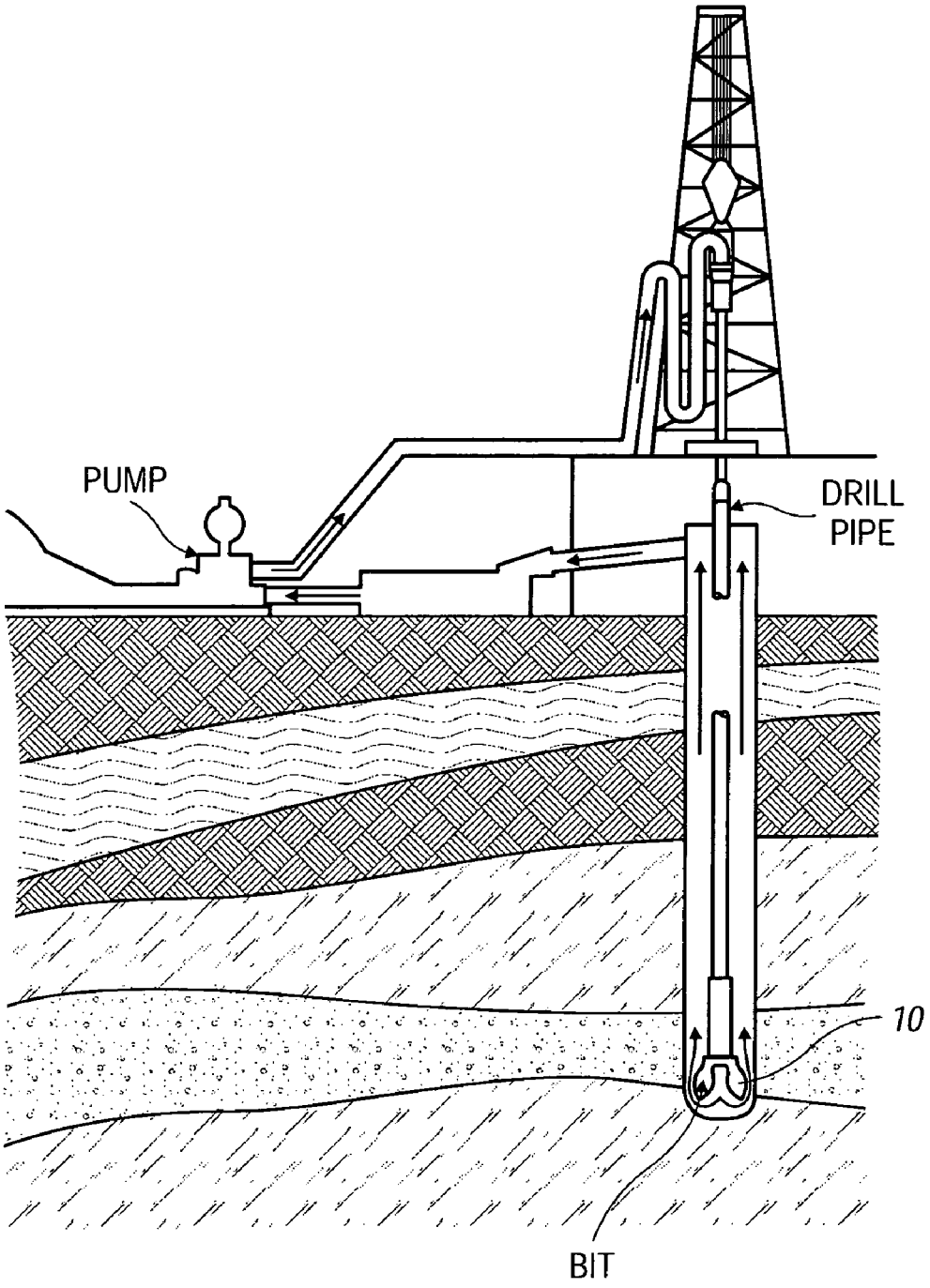
FIG. 4 is a view of a drill rig which can use a drill bit having the innovative design.

FIG. 2 shows drill bit cone 20 with inserts demonstrating the innovative groove. Like FIG. 1, this drawing shows the location of inserts 22 for each of the three cones on a bit, the position of the inserts 22 being the major difference between the three cones. The inner surface of cone is again shaped to form journal bearings at 11 and 13, to allow room for roller bearings at 15 and to provide a gland 17 for the elastomeric seal. Innovative groove 16 is only shown on the left side of this drawing, but can be used on both of these cones.

Experiments were conducted with drill bits having cones like those of FIG. 2. Field tests were run to address bearing lifetime improvement in the Mid-Continent Area, using the IADC 527Y type bit. As with most insert bit types, bearing performance in this Area is usually controlled by the journal seal life, and more specifically the effect which cuttings packing has on seal life. Seal failure is then the primary controlling factor on bearing life.

The objective of this test was to see how the special cone groove might affect the cuttings packing problem. It was hoped that the groove would improve circulation adjacent to the arm-to-cone dynamic interface, so that seal life would be increased.

The first design to incorporate the new cone groove was the 7-⅞XS25. The special assembly also incorporated the "brittle plug", which protruded into the cone groove to further decrease the potential for packing of cuttings at the journal seal (arm-to-cone) dynamic surface. (There are additional design objectives of the "brittle plug" that are not addressed here.) An initial quantity of six rock bits was manufactured for field performance evaluation. All six of the initial B187 bits have been run in the Mid-Continent Area. Results have been above-average at worst, exceptional at best. The five bits for which valid results were obtained ran 179.5, 130.5, 139.5, 168.0, and 171.8 hours, all with seals effective. (The sixth bit was considered a "no test," due to abuse by the rig.) These results are very impressive, and indicate lifetimes about 20% longer than would be typical for this type of bit in this location. This is a very significant improvement.

Note that the inclusion of the cone groove results in a loss of cone steel at the hole wall, but the enhanced localized cleaning far outweighs any negative effect on cutting structure performance. This is a surprising benefit from reducing the strength of the cone near the seal gland.

Figure 6:
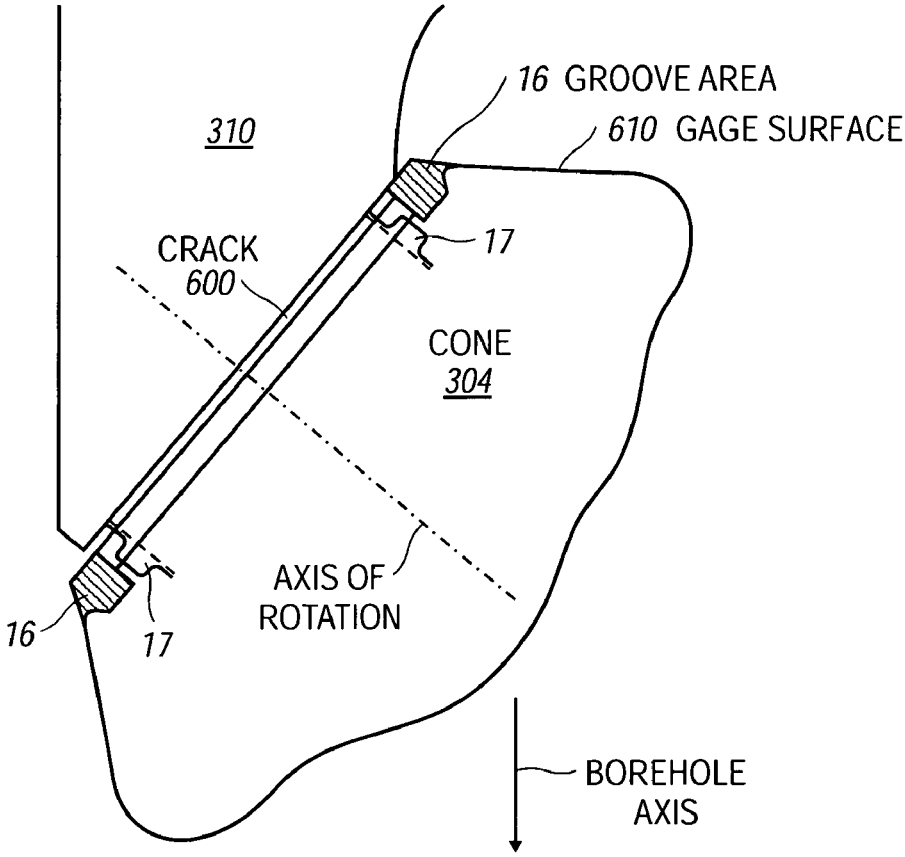
FIG. 6 illustrates an example of the location of the novel groove with respect to the arm of the drill bit.

FIG. 6 illustrates an example of the location of the novel groove 16 with respect to the arm of the drill bit. (The bearings inside the cone are not shown, but the seal gland 17 is shown in phantom.) A crack 600 separates the moving cone from the (relatively) stationary arm. (The whole drill bit rotates around the borehole axis, but the cone also rotates around the bearings which connect it to the extended part of the arm.) The illustrated configuration of the groove 16 is not the only possible one, since there are many alternative embodiments, as the following drawings will illustrate. The groove 16 appears to allow active mud flow in the neighborhood of the crack 600, which surprisingly reduces sedimentation and incursion into the crack. Note that the groove 16 is accordingly made larger than 0.100 inches, and preferably more than 5 times the initial width of the crack.

Figure 5:
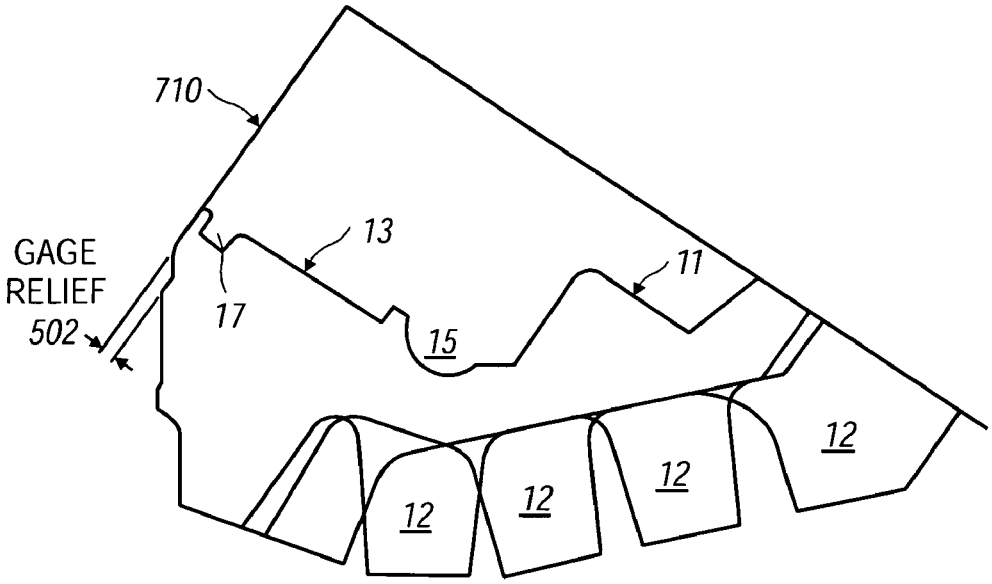
FIG. 5 (PRIOR ART)
FIG. 5 is an exemplary view of a prior art journal/cone; the journal of a rotary cone drill bit is shown with roller and ball bearings and seal in place, shown against a cross-section of a cone, which is seen only in outline. The arm of the bit is in the upper left corner of the drawing.

By contrast, in the prior art cone of FIG. 5 a small amount of gage relief (dimension 502) has been added to the cone backface 710 where it intersects the gage surface. It is important to note that this relief 502 has much smaller dimensions than the preferred groove, and was not directed to the same function.

Figure 7:
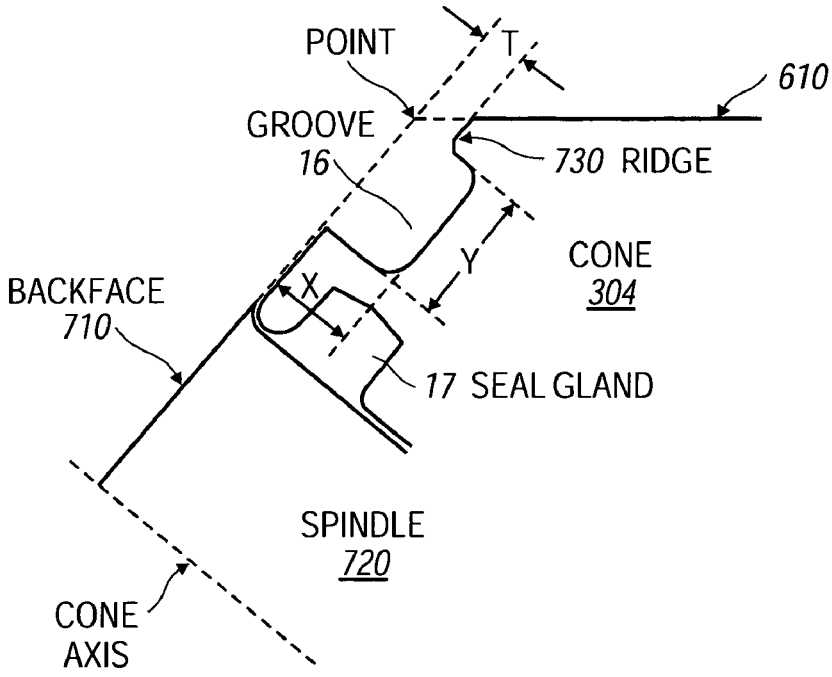
FIG. 7 is a sectional detail of the area of the innovative groove and seal gland for one embodiment.

FIG. 7 is a close-up of the area where the seal gland 17 and the innovative groove 16 are located in one embodiment. This drawing is not to scale, but gives some relative idea of the location of the groove along the backface 710 of the cone and near to the gage area. The seal gland 17 is close by, but faces a different direction. The configuration of this groove 16 allows a substantial cross sectional area for the circulating mud to channel in when cones are rotating. The novel groove has an axial dimension "X", a radial dimension (height) "Y", and is bounded by a ridge 730 which has a gap spacing "T" relative to the cone backface. (If the arm is also recessed, as in embodiments described below, then the gap spacing will be increased by the depth of the arm recess.) In this sample embodiment, the X dimension is relative to bit size, preferably no less than 0.100 inches and e.g. in the neighborhood of 2.5% of bit diameter. Y=1 to 1.6 times X and T=0.5 times X up to X. In this example the ridge 730 has a dimension r=0.020 inches minimum on the arm. Note that the spindle 720, i.e. the downwardly angled extension of the arm 310 on which the cone is actually mounted, is visible in this drawing.

Figure 8:
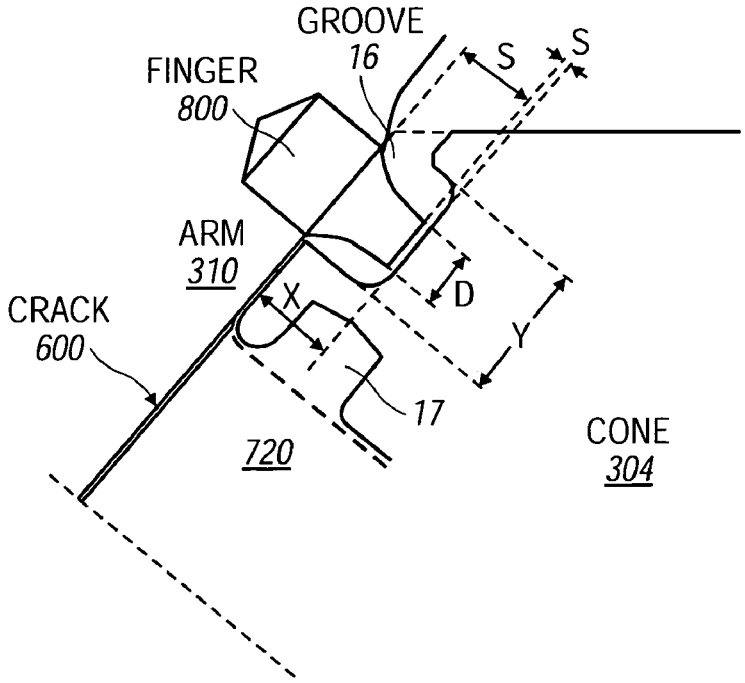
FIG. 8 is a close-up of the groove area in an alternate embodiment in which a finger extends from the body of the bit into the groove.

FIG. 8 is a close-up of the groove area in an alternate embodiment in which a finger 800 extends from the arm 310 into the groove. Part of the function of this finger is in "wiping" away any mud or sediments, protecting the crack 600 between the cone and the arm from mud packing; but a further effect is in modifying the mud flow around the cone groove 16.

Note also that the proximity of turbulent mud flow (in groove 16) to the seal area allows the circulating mud to better cool the seal, thus reducing the cooling temperature and extending seal life.

Figure 9:
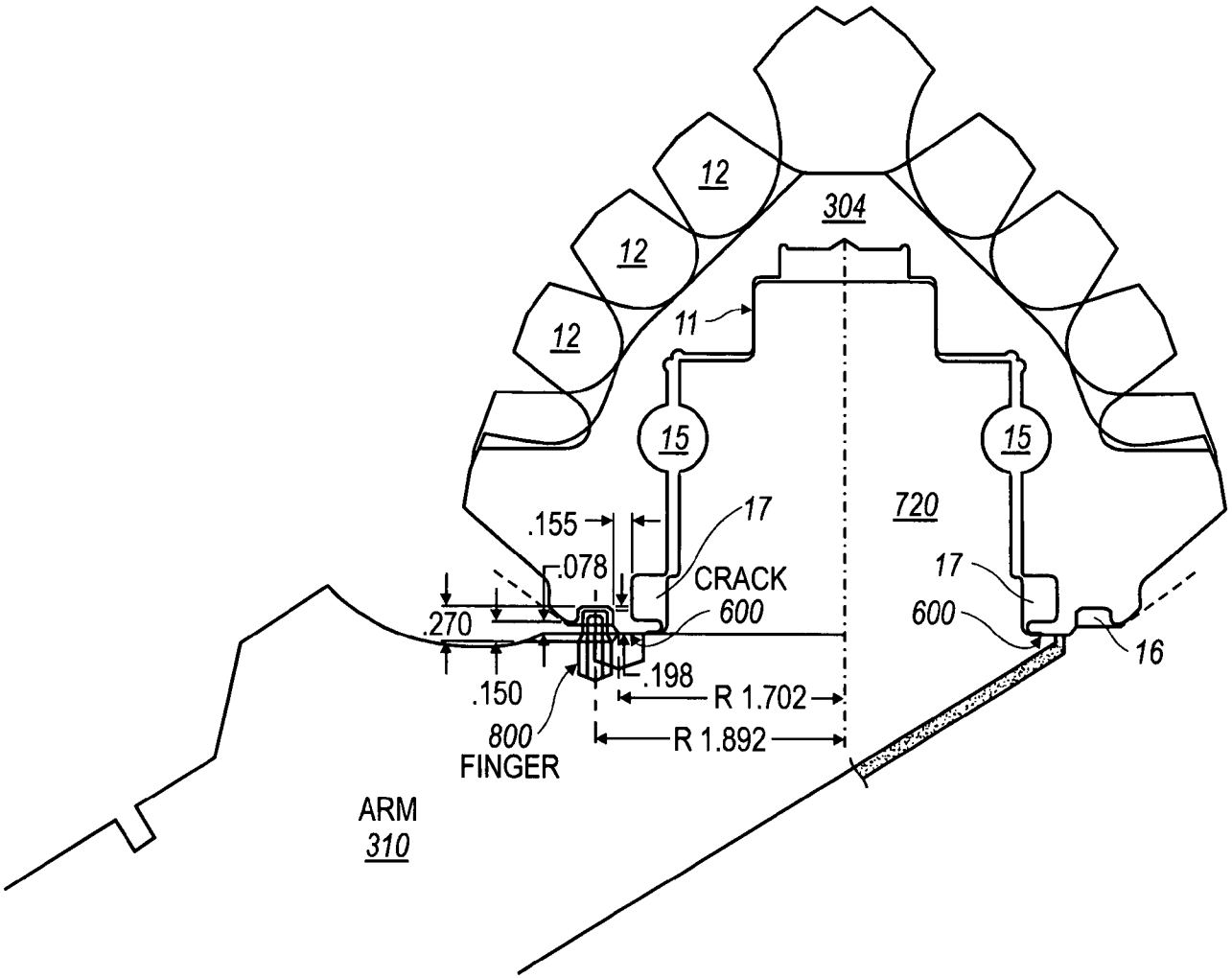
FIG. 9 shows a further enhancement, which includes modifying the arm adjacent to the groove to enhance the beneficial action.

FIG. 9 shows a further enhancement, which includes modifying the arm adjacent to the groove to enhance the beneficial action. In the presently preferred embodiment, the groove on the cone is used in combination with a matching recess on the arm of depth (in this example) of 0.072 inches. This depth is a function of some parameters of the arm and could be up to "T" preferred maximum dimension. The dimensions of this embodiment are for a 9⅞ inch bit. In this sample embodiment the finger 800 has a width of 0.220 inches, and the height of the groove is 0.270 inches. Note that 0.072 inches of the groove's height is provided by the recess in the arm, which is aligned with the 0.198 inch deep recess in the cone's backface. The ridge leaves a gap of 0.150 inches on the outboard side of the groove. Note also that the web thickness behind the seal gland is only 0.155 inches. The seal gland dimensions, in this sample embodiment, are approximately 0.350 inches axial by about 0.270 inches radial. Thus in this example the web thickness behind the gland is less than half the axial dimension of the gland. Note also that the end of crack 600 opens suddenly, over an angle of about 135 degrees (as seen in a section normal to the crack). The finger 800, in this embodiment, has been given about 0.030 inches clearance to the inboard and top walls of the groove.

Figure 10:
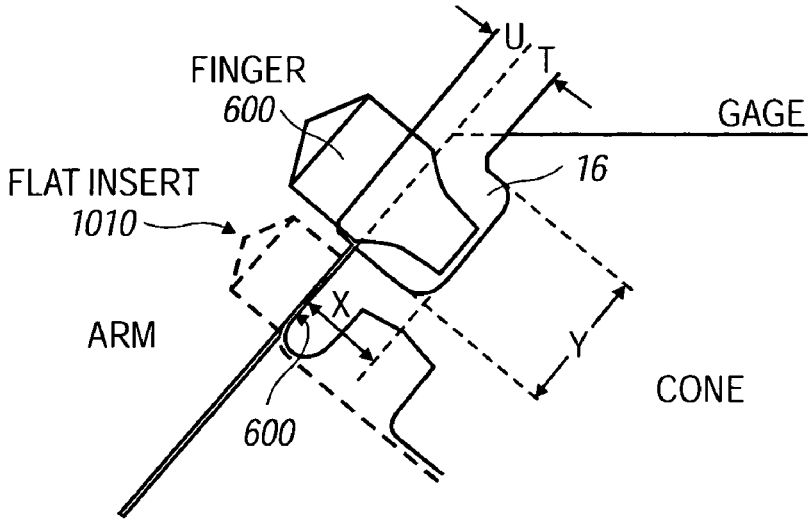
FIG. 10 shows a further enhancement to the innovative groove, where a flat insert in the crack between the arm and the cone backface will further protect the surfaces mentioned.

FIG. 10 shows a further enhancement to the innovative groove, where a flat insert 1010 in the crack 600 between the arm and the cone backface will further protect the surfaces mentioned. (The flat insert is shown in phantom, since it would typically not be at the same position as the finger 800 which is also shown.)

FIGS. 11A–11H show a number of alternate embodiments of the groove, showing possible shapes of both the groove in the cone and a corresponding shape change in the arm.

Figure 11A:
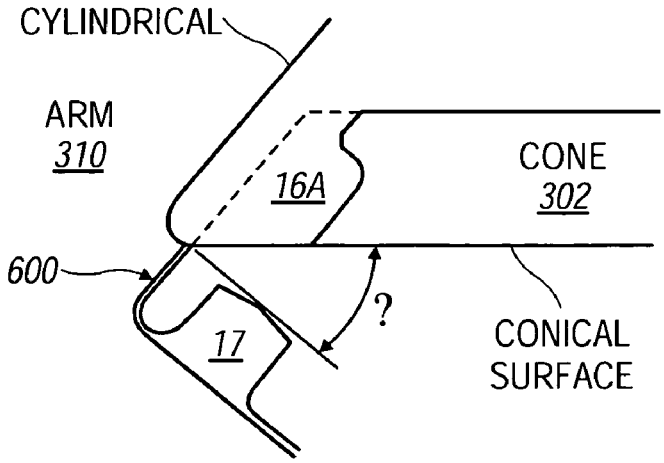
FIGS. 11A–11H show a number of alternate embodiments of the groove, showing possible shapes of both the groove in the cone and a corresponding shape change in the arm.

In FIG. 11A the dynamic crack 600 opens into a groove 16A which has a conical (rather than cylindrical) surface where the crack intersects it.

Figure 11B:
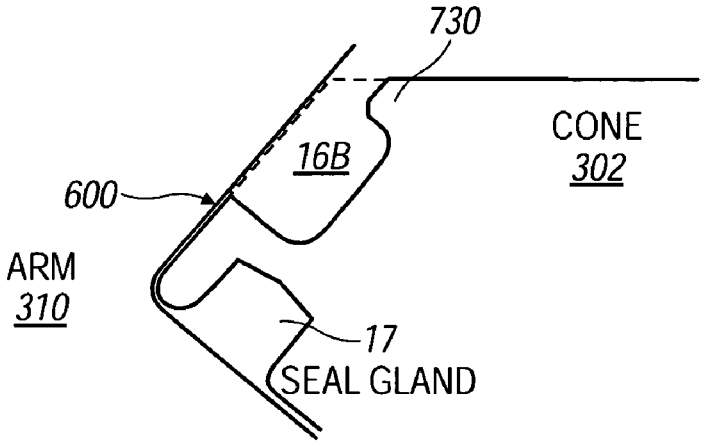

In FIG. 11B the groove 16B is more than 0.100 inches high, and is partially bounded by a ridge 730, but does NOT include a recess into the arm 310.

Figure 11C:
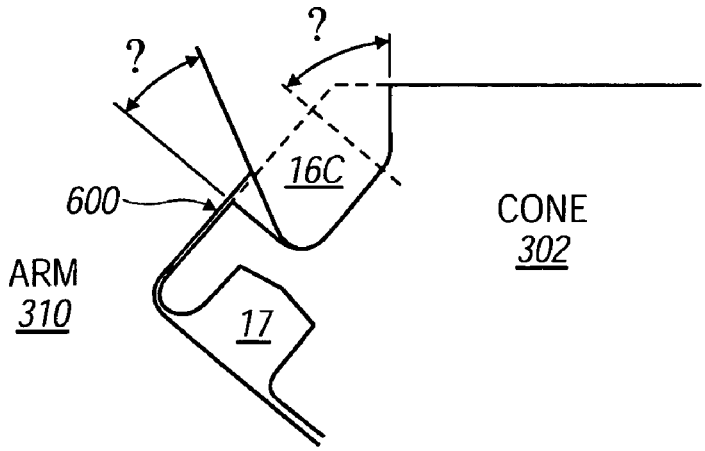

In FIG. 11C the dynamic crack 600 opens into a groove 16C which has a conical (rather than cylindrical) surface where the crack intersects it.

Figure 11D:
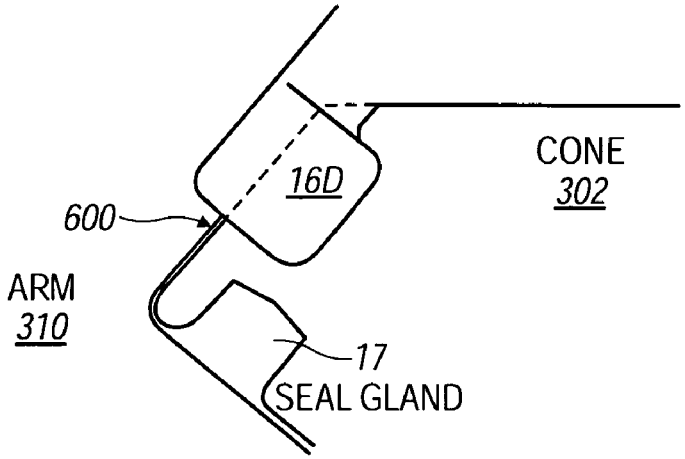

In FIG. 11D the groove 16D has a cross-section which is more nearly rectangular than the circular and oval shapes used in other embodiments.

Figure 11E:
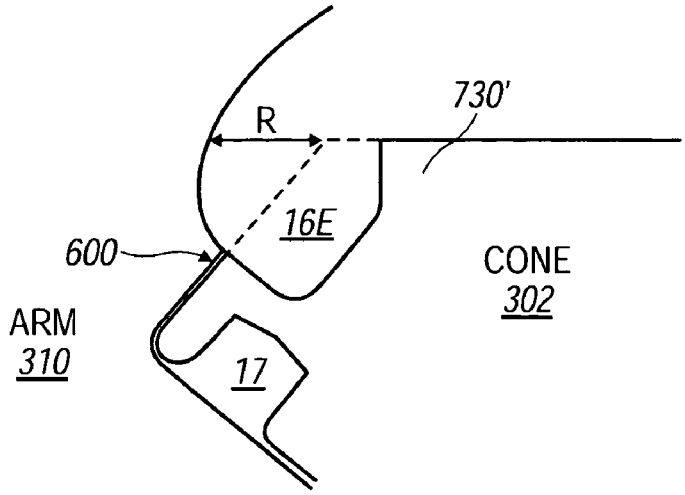

In FIG. 11E the groove 16E has a cross-section which is more precisely circular than those used in other embodiments. Note also that ridge 730' has a lip which is sharper than the ridge 730 shown previously.

Figure 11F:
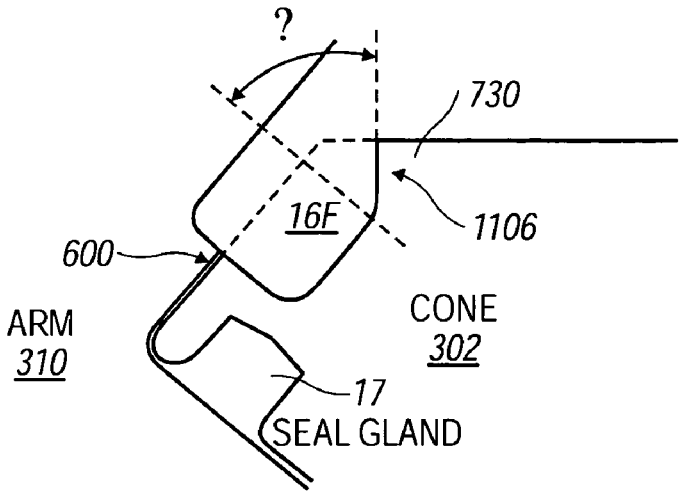

In FIG. 11F the groove 16F has a cross-section which is partially defined by conical surface 1106, with a cone angle shown as beta in this example.

Figure 11G:
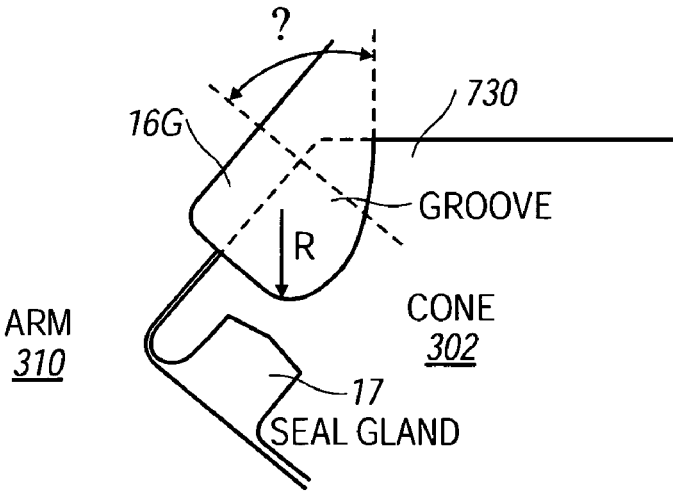

In FIG. 11G the groove 16G has a cross-section which is a hybrid of the shapes of grooves 16E and 16F.

Figure 11H:
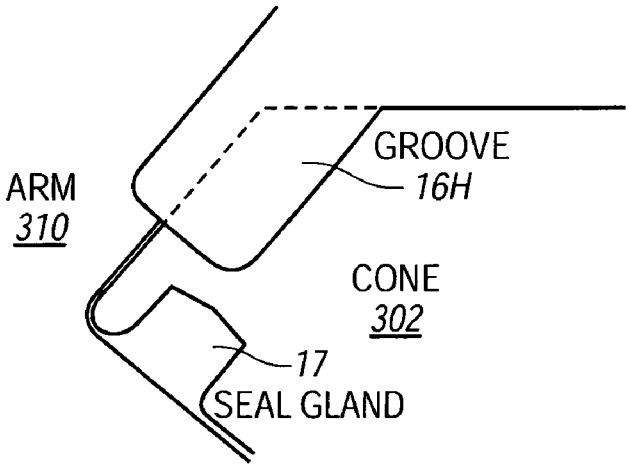

FIG. 11H shows how the cone angle beta, illustrated in FIG. 11F, can be increased up to 90 degrees, in which case there is no longer any ridge 730.

FIGS. 12A–H show alternative embodiments of the finger 800, in relation to different shapes of the groove 16.

Figure 12A:
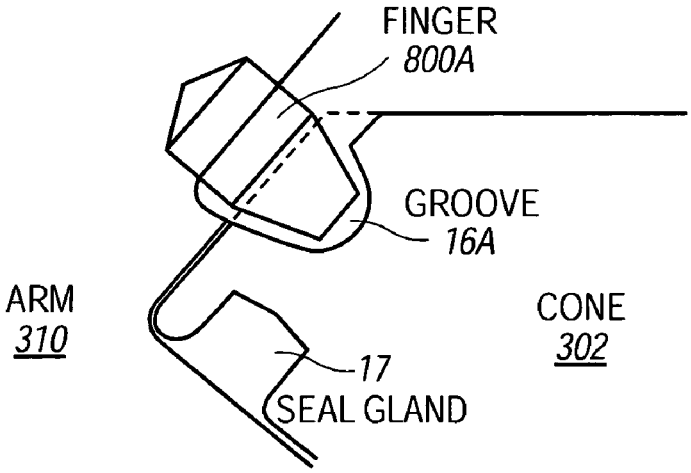
FIGS. 12A–12H show a number of alternate embodiments of the finger, in relation to different groove shapes.

FIG. 12A shows how a finger 800A matches the groove 16A shown in FIG. 11A.

Figure 12B:
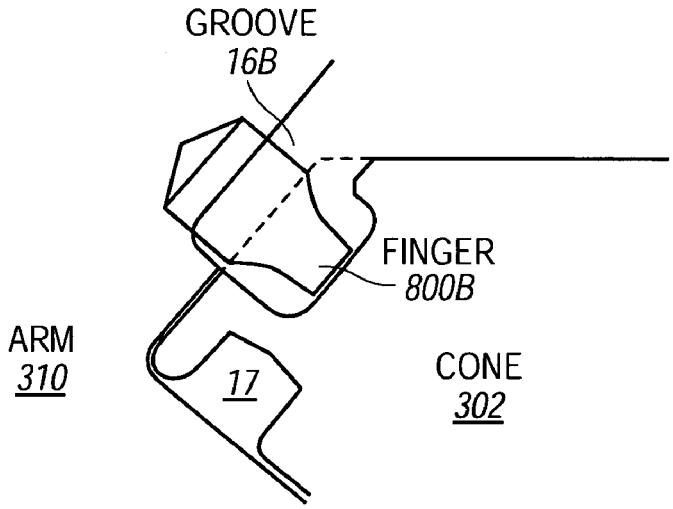

FIG. 12B shows how a finger 800B matches the groove 16B shown in FIG. 11B.

Figure 12C:
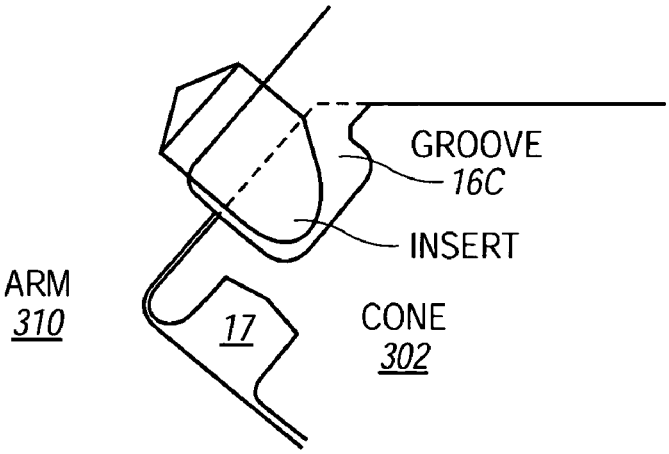

FIG. 12C shows how a finger 800C matches the groove 16C shown in FIG. 11C.

Figure 12D:
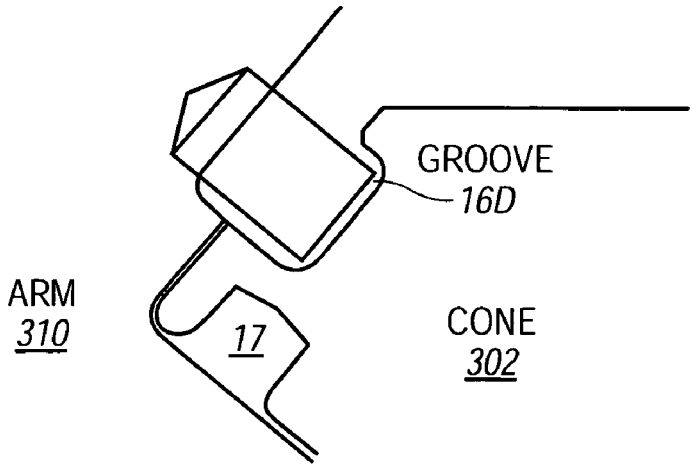

FIG. 12D shows how a finger 800D matches the groove 16D shown in FIG. 11D.

Figure 12E:
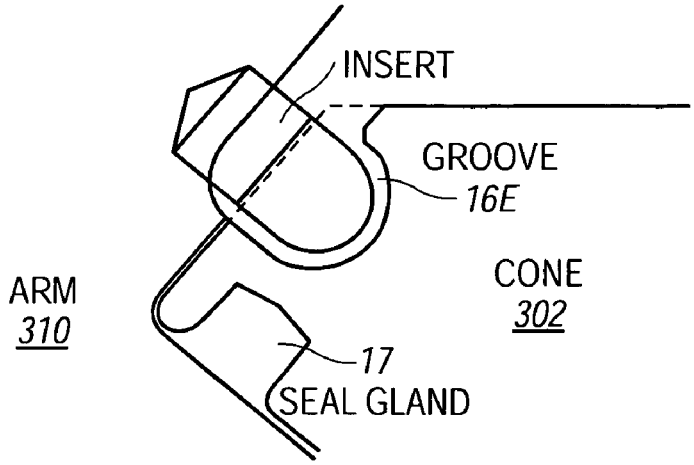

FIG. 12E shows how a finger 800E matches the groove 16E shown in FIG. 11E.

Figure 12F:
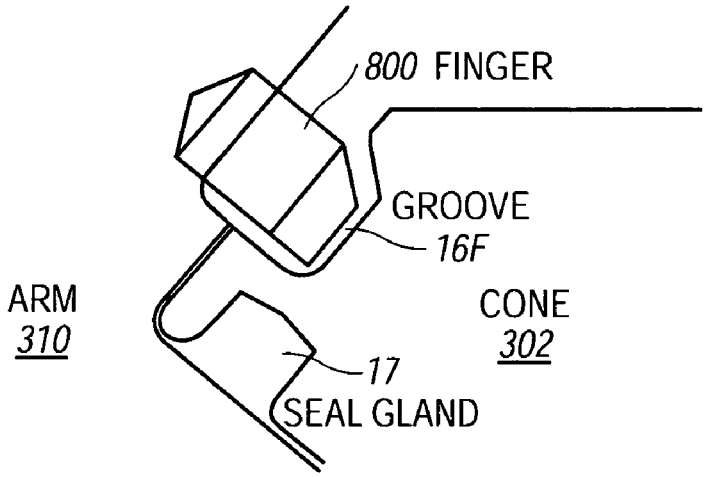

FIG. 12F shows how a finger 800F matches the groove 16F shown in FIG. 11F.

Figure 12G:
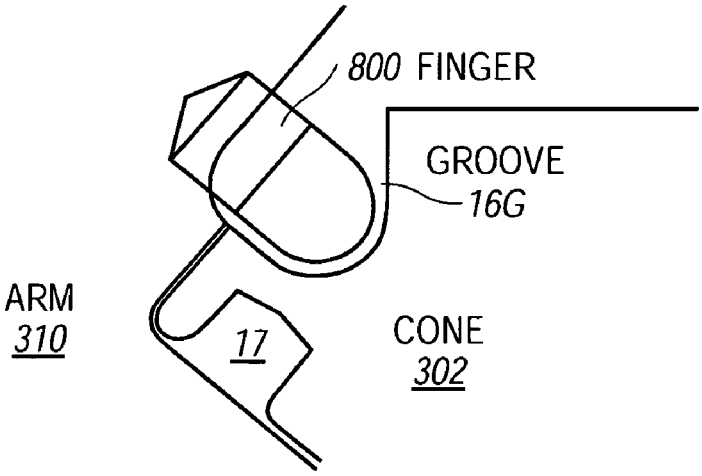

FIG. 12G shows how a finger 800G matches the groove 16G shown in FIG. 11G.

Figure 12H:
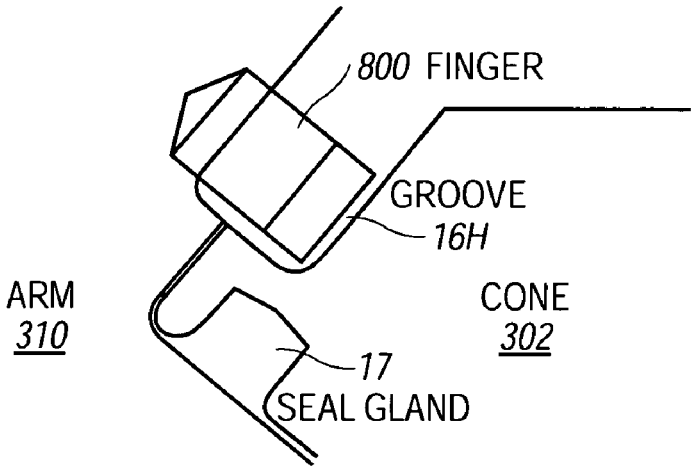

FIG. 12H shows how a finger 800H matches the groove 16H shown in FIG. 11H.

FIGS. 13A–13D show a number of alternate embodiments where both the groove and the seal gland can take varying shapes. In particular, these Figures show how the disclosed inventions can be applied to a variety of existing seal configurations.

Figure 13A:
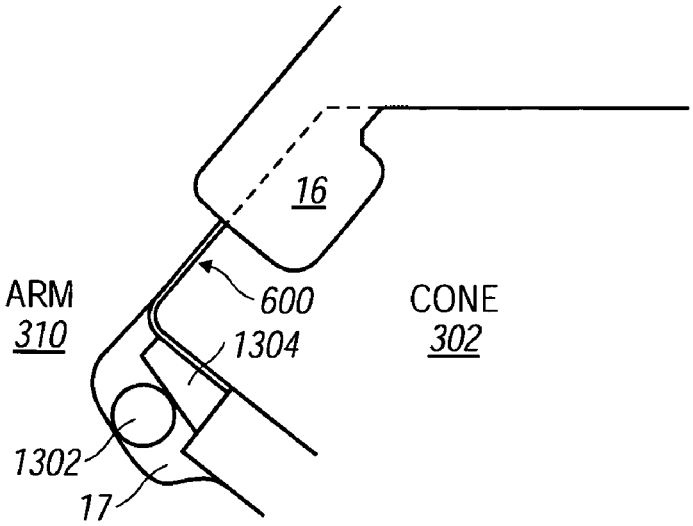
FIGS. 13A–13D show a number of alternate embodiments where both the groove and the seal gland can take varying shapes.

In FIG. 13A, the sealing structure includes components 1302 and 1304 in the same gland. Here again, the dynamic crack opens into a widened groove 16, which provides reduced sediment incursion.

Figure 13B:
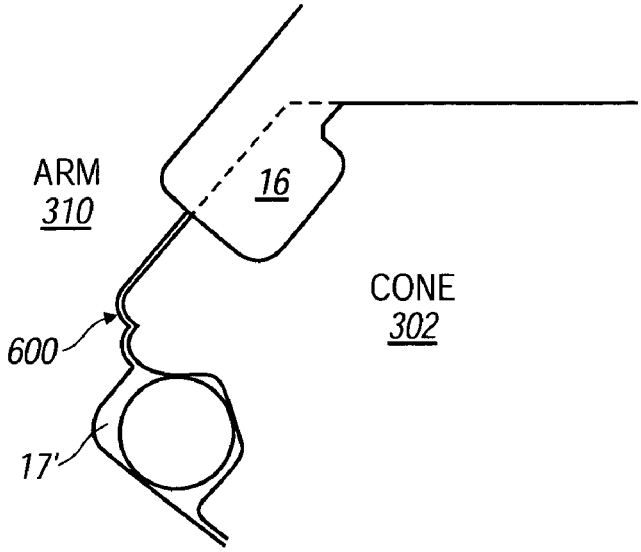

In FIG. 13B, the gland 17' does not have parallel walls, and the dynamic crack 600 is itself slightly nonplanar. Here again, the dynamic crack opens into a widened groove 16, which provides reduced sediment incursion.

Figure 13C:
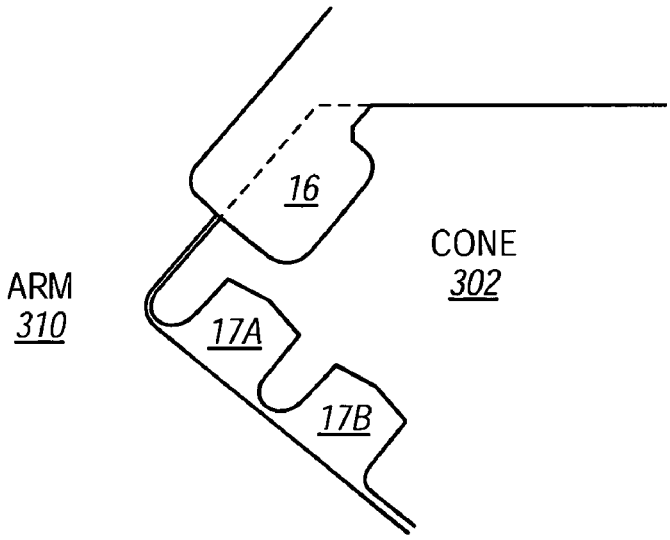

FIG. 13C shows a double seal structure, with two glands 17A and 17B. Note again that the minimum web thickness behind the seal gland (behind portion 17A in this example), is relatively small, and preferably smaller than the gland depth. Again, the dynamic crack opens into a widened groove 16, which provides reduced sediment incursion.

Figure 13D:
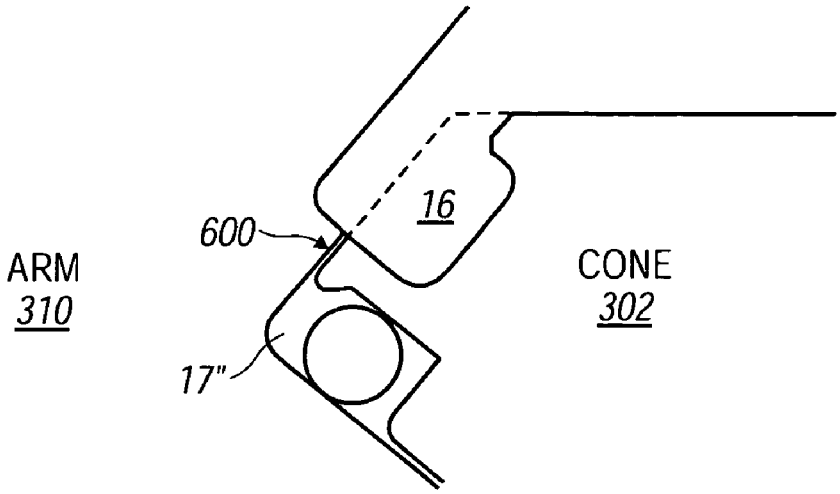

In FIG. 13D shows yet another conventional configuration for gland 17". (This gland configuration too does not have parallel walls, and has a relatively minimal outboard wall.) Here again, the dynamic crack 600 opens into a widened groove 16, which provides reduced sediment incursion.

Note that, in many of the disclosed embodiments, the groove backs up to the seal gland. In these embodiments the cone can be described as having a skirt (including the web behind the seal gland, and the cone-side surface of the crack). Many of these embodiments have a distinctive geometry, in that this "skirt" has a length (from the start of the seal gland) which is more than twice, and preferably more than three times, its thickness. This geometry is a result of the volume given to the innovative open groove.

Turbulence is typically measured by a dimensionless parameter known as a Reynolds number. The various disclosed structures have the effect of increasing the Reynolds number in proximity to the crack.

For a confined steady flow, Reynolds number can be written as $$\mathrm{Re} = K\frac{\rho\bar{v}D}{\mu},$$

where:

D is the (theoretical) diameter of the confined space;

K is a shape factor (which is at a maximum of 1, for a round pipe);

v bar is average bulk velocity magnitude;

μ is viscosity; and

ρ is density.

Theoretical diameter D is derived from the cross-sectional area, as $$D = \sqrt{\frac{4A_s}{\pi}},$$

so we have $$\mathrm{Re} = \frac{K\rho\bar{v}\sqrt{4A_s}}{\mu\sqrt{\pi}}.$$

Leaving out the factors which are not affected by the mechanical shapes, we find that the variation in Reynolds numbers can be shown as $$Re \propto K\sqrt{A}.$$

This shows that the shape factor has a major effect. For (e.g.) an elliptical section, where sectional area is equal to pi over 4 times the product of maximum diameter $D_{max}$ with minimum diameter $D_{min}$, this reduces to $$Re \propto D_{min}\sqrt{K}.$$

which shows how both the minimum diameter AND the shape factor limit Reynold's number in steady flows (and correspondingly damp driven turbulence). (The same relation applies for sections of any specified proportion.)

In the embodiment which was successfully tested (as described above), the groove defines a shape factor, adjacent to the crack, which is estimated to be fairly high (approximately 0.8). By contrast, in conventional bits this shape factor would be much smaller, in the neighborhood of 0.2 (since the cross-section of the open space is much flatter). As compared with a conventional bit, the embodiment which was successfully tested has not only a cross-sectional area which is approximately 16 times greater, but also a shape factor which is roughly four times higher. This produces a Reynolds number which more than an order of magnitude larger. This substantial increase in turbulence helps to avoid deposition of sediments near the crack.

Where turbulence is driven by exogenous factors, this classical formula is a simplification; if high-velocity flow components are being introduced into the stream, then the velocity term may need to be adjusted accordingly. However, the above analysis does show how both the shape and area terms affect damping of driven turbulent flows.

Design Methodologies

As noted above, the benefits of a large groove at the opening of the crack are substantial. Without relying on detailed fluid dynamic simulations of the bottom-hole environment, there are several heuristic design techniques which can be helpful in reducing sedimentation. Some of these alternative ways to introduce an appropriately large groove into an existing or proposed bit design include:

- Modifications which would tend to increase the flow across the crack opening;
- Modifications which would tend to increase the peak flow velocity in proximity to the crack opening;
- Modifications which would tend to create suction at the crack opening;
- Reducing the web thickness which backs up the seal gland, to increase the volume where the crack opens;
- Designing a recess into the arm at the end of the crack, so that the end of the crack opens out into a groove which is carved out both from the arm and from the cone;
- Removing metal around the "C" point shown in FIG. 7 (i.e. the point, on a sectional drawing, where the cone's backface surface intersects the gage surface), to create more open volume where the crack ends.

According to a disclosed class of innovative embodiments, there is provided: A bit for downhole rotary drilling, comprising: a body supporting at least one arm/spindle structure; and a cutting element mounted on said arm/spindle structure through one or more rotary bearings; wherein said cutting element and said arm/spindle structure jointly define a crack which is interposed between said bearings and the cuttings-laden fluid; and wherein said cutting element also incorporates a rimmed groove, in the back face thereof, which is more than 0.100 inch deep.

According to another disclosed class of innovative embodiments, there is provided: A bit for downhole rotary drilling, comprising: a body supporting at least one arm/spindle structure; a cutting element mounted on said arm/spindle structure through one or more rotary bearings; and a rotary seal, contacting both said cutting element and said spindle to exclude cuttings-laden fluid from said bearings; wherein said cutting element and said arm/spindle structure jointly define a crack which is interposed between said rotary seal and the cuttings-laden fluid; and wherein said cutting element incorporates a groove, in the back face thereof, which is more than 0.100 inch deep.

According to another disclosed class of innovative embodiments, there is provided: A bit for downhole rotary drilling, comprising: a body supporting at least one arm/spindle structure; a cutting element mounted on said arm/spindle structure through one or more rotary bearings; and a rotary seal, contacting both said cutting element and said spindle to exclude cuttings-laden fluid from said bearings; wherein said cutting element and said arm/spindle structure jointly define a crack which is interposed between said rotary seal and the cuttings-laden fluid; and wherein said cutting element incorporates a groove, in the back face thereof, which is more than 0.01 square inches in section; and wherein said arm/spindle structure incorporates a finger which protrudes into said groove to clear sludge therefrom.

According to another disclosed class of innovative embodiments, there is provided: A bit for downhole rotary drilling, comprising: a body supporting at least one arm/spindle structure; a cutting element mounted on said arm/spindle structure through one or more rotary bearings; and a rotary seal, contacting both said cutting element and said spindle to exclude cuttings-laden fluid from said bearings; wherein said cutting element and said arm/spindle structure jointly define a crack which is interposed between said rotary seal and the cuttings-laden fluid; and wherein said cutting element incorporates a groove, in the back face thereof, which is more than 0.02 square inches in section.

According to another disclosed class of innovative embodiments, there is provided: A bit for downhole rotary drilling, comprising: a body supporting at least one arm/spindle structure; a cutting element mounted on said arm/spindle structure through one or more rotary bearings; and a rotary seal, contacting both said cutting element and said spindle to exclude cuttings-laden fluid from said bearings; wherein said cutting element and said arm/spindle structure jointly define a crack which is interposed between said rotary seal and the cuttings-laden fluid; and wherein both said cutting element and said arm/spindle structure are relieved where said crack opens onto the cuttings-laden fluid, to expose drilling fluid over a cross-sectional angle of more than 135 degrees.

According to another disclosed class of innovative embodiments, there is provided: A bit for downhole rotary drilling, comprising: a body supporting at least one arm/spindle structure; a cutting element mounted on said arm/spindle structure through one or more rotary bearings; and a rotary seal, contacting both said cutting element and said spindle to exclude cuttings-laden fluid from said bearings; wherein said cutting element and said arm/spindle structure jointly define a crack which is interposed between said rotary seal and the cuttings-laden fluid; and wherein both said cutting element and said arm/spindle structure are relieved, where said crack opens onto the cuttings-laden fluid, to expose drilling fluid over a solid angle of more than 4 steradians.

According to another disclosed class of innovative embodiments, there is provided: A bit for downhole rotary drilling, comprising: a body supporting at least one arm/spindle structure; and a cutting element mounted on said arm/spindle structure through one or more rotary bearings; wherein said cutting element and said arm/spindle structure jointly define a crack which is interposed between said bearings and the cuttings-laden fluid; and wherein said cutting element incorporates a groove, in the back face thereof, which defines a channel having a shape factor of more than 0.5 (defined with reference to a round tube's shape factor of 1.0).

According to another disclosed class of innovative embodiments, there is provided: A rotary cutting component for a roller-cone drill bit, comprising: cutters on a body; and a seal gland, and a backface outboard of said gland; said backface terminating in a dihedral angle of at least 75 degrees.

According to another disclosed class of innovative embodiments, there is provided: A method of designing a bit for rotary drilling, comprising the actions of: adding additional space, where the dynamic crack between cone and arm enters open mud volume, to increase the peak flow velocity at the opening of crack.

Modifications and Variations

As will be recognized by those skilled in the art, the innovative concepts described in the present application can be modified and varied over a tremendous range of applications, and accordingly the scope of patented subject matter is not limited by any of the specific exemplary teachings given.

For example, in various embodiments the seal does not have to be an O-ring, or the shape of the gland may be different from those shown. A cross-section of the seal can be, for example, oval, with an radial to axial ratio of 1.5:1, 2:1, or more.

In alternative embodiments, the finger's clearance to the inboard and/or top walls of the groove can be different from that shown. Similarly, the finger's cross-section does not have to be circular.

Similarly, the seal structure itself can be backed by additional elements, or a polymer barrier can be added to provide a sacrificial barrier against the incursion of particulates.

Similarly, the disclosed innovations can be used in combination with a double seal structure.

In another contemplated class of embodiments the disclosed structure can be applied to milled-tooth cutters. In fact, it is contemplated that the disclosed inventions can be especially advantageous in such environments, especially in shaley formations which can provide very sticky residues.

Of course, the disclosed inventions are also applicable to bits with two, three, one, or four cones.

The recess in the arm, if used, does not necessarily have to be perfectly uniform all the way around the spindle. In alternative less preferred embodiments, the shape of the recess in the arm can be different in the position closest to the borehole wall.

Also, the shape of the cutting element (cone) does not have to be conical, and various cone profiles can be used.

Another contemplated class of embodiments is to bits which do not use seals. Even if there is no rotary seal behind the crack, the reduction of sedimentation at the crack opening is still believed to provide advantages of reduced infiltration of debris into the bearings.

Additional general background, which helps to show the knowledge of those skilled in the art regarding implementation options and the predictability of variations, may be found in the following publications, all of which are hereby incorporated by reference: Baker, A Primer of Oilwell Drilling (5.ed. 1996); Bourgoyne et al., Applied Drilling Engineering (1991); Davenport, Handbook of Drilling Practices (1984); Drilling (Australian Drilling Industry Training Committee 1997); Fundamentals of Rotary Drilling (ed. W. W. Moore 1981); Harris, Deepwater Floating Drilling Operations (1972); Maurer, Advanced Drilling Techniques (1980); Nguyen, Oil and Gas Field Development Techniques: Drilling, (1996 translation of 1993 French original); Rabia, Oilwell Drilling Engineering/Principles and Practice (1985); Short, Introduction to Directional and Horizontal Drilling (1993); Short, Prevention, Fishing & Repair (1995); Underbalanced Drilling Manual (Gas Research Institute 1997); the entire PetEx Rotary Drilling Series edited by Charles Kirkley, especially the volumes entitled Making Hole (1983), Drilling Mud (1984), and The Bit (by Kate Van Dyke, 4.ed. 1995); the SPE reprint volumes entitled "Drilling," "Horizontal Drilling," and "Coiled-Tubing Technology"; and the Proceedings of the annual IADC/SPE Drilling Conferences from 1990 to date; all of which are hereby incorporated by reference.

None of the description in the present application should be read as implying that any particular element, step, or function is an essential element which must be included in the claim scope: THE SCOPE OF PATENTED SUBJECT MATTER IS DEFINED ONLY BY THE ALLOWED CLAIMS. Moreover, none of these claims are intended to invoke paragraph six of 35 USC section 112 unless the exact words "means for" or "step for" are followed by a participle.

What is claimed is:

1. A bit for downhole rotary drilling, comprising:

a body supporting at least one arm/spindle structure; and a cutting element mounted on said arm/spindle structure through one or more rotary bearings;

wherein said cutting element and said arm/spindle structure jointly define a crack, having an initial width, which is interposed between said bearings and the cuttings-laden mud; and wherein said cutting element also incorporates a rimmed groove, in the back face thereof, which is more than 0.100 inch deep and at least five times the initial width of said crack.

2. The bit of claim 1, wherein said groove is defined both by a recess in said cutting element, and also by a recess in said arm.

3. The bit of claim 1, wherein a finger extends into said groove for a length of more than 0.100 inches.

4. A method for downhole rotary drilling, comprising the use of a bit according to claim 1.

5. A drill rig, comprising a bit according to claim 1.

6. A bit for downhole rotary drilling, comprising:

a body supporting at least one arm/spindle structure;

a cutting element mounted on said arm/spindle structure through one or more rotary bearings; and a rotary seal, contacting both said cutting element and said spindle to exclude cuttings-laden mud from said bearings;

wherein said cutting element and said arm/spindle structure jointly define a crack, having an initial width, which is interposed between said rotary seal and the cuttings-laden mud; and wherein said cutting element incorporates a rimmed groove, in the back face thereof, which is more than 0.100 inch deep and at least five times the initial width of said crack.

7. The bit of claim 6, wherein said groove is defined both by a recess in said cutting element, and also by a recess in said arm.

8. A method for downhole rotary drilling, comprising the use of a bit according to claim 6.

9. A drill rig, comprising a bit according to claim 6.

10. A bit for downhole rotary drilling, comprising:

a body supporting at least one arm/spindle structure;

a cutting element mounted on said arm/spindle structure through one or more rotary bearings; and a rotary seal, contacting both said cutting element and said spindle to exclude cuttings-laden mud from said bearings;

wherein said cutting element and said arm/spindle structure jointly define a crack, having an initial width, which is interposed between said rotary seal and the cuttings-laden mud;

wherein said cutting element incorporates a groove, in the back face thereof, which is more than 0.100 inch deep and at least five times the initial width of said crack; and wherein a finger extends into said groove for a length of more than 0.100 inches.

11. A method for downhole rotary drilling, comprising the use of a bit according to claim 10.

12. A drill rig, comprising a bit according to claim 10.

13. A bit for downhole rotary drilling, comprising:

a body supporting at least one arm/spindle structure;

a cutting element mounted on said arm/spindle structure through one or more rotary bearings; and a rotary seal, contacting both said cutting element and said spindle to exclude cuttings-laden mud from said bearings;

wherein said cutting element and said arm/spindle structure jointly define a crack, having an initial width, which is interposed between said rotary seal and the cuttings-laden mud; and wherein said cutting element incorporates a rimmed groove, in the back face thereof, which is more than 0.01 square inches in section and at least five times the initial width of said crack; and wherein said arm/spindle structure incorporates a finger which protrudes into said groove to clear sludge therefrom.

14. The bit of claim 13, wherein said groove is defined both by a recess in said cutting element, and also by a recess in said arm.

15. A method for downhole rotary drilling, comprising the use of a bit according to claim 13.

16. A drill rig, comprising a bit according to claim 13.

17. A bit for downhole rotary drilling, comprising:

a body supporting at least one arm/spindle structure;

a cutting element mounted on said arm/spindle structure through one or more rotary bearings; and a rotary seal, contacting both said cutting element and said spindle to exclude cuttings-laden mud from said bearings;

wherein said cutting element and said arm/spindle structure jointly define a crack, having an initial width, which is interposed between said rotary seal and the cuttings-laden mud;

wherein said cutting element incorporates a groove, in the back face thereof, which is more than 0.01 square inches in section and at least fiye times the initial width of said crack;

wherein said arm/spindle structure incorporates a finger which protrudes into said groove to clear sludge therefrom; and wherein said finger extends into said groove for a length of more than 0.100 inches.

18. A method for downhole rotary drilling, comprising the use of a bit according to claim 17.

19. A bit for downhole rotary drilling, comprising:

a body supporting at least one arm/spindle structure;

a cutting element mounted on said arm/spindle structure through one or more rotary bearings; and a rotary seal, contacting both said cutting element and said spindle to exclude cuttings-laden mud from said bearings;

wherein said cutting element and said arm/spindle structure jointly define a crack, having an initial width, which is interposed between said rotary seal and the cuttings-laden mud; and wherein said cutting element incorporates a rimmed groove, in the back face thereof, which is more than 0.02 square inches in section and at least five times the initial width of said crack.

20. The bit of claim 19, wherein said groove is defined both by a recess in said cutting element, and also by a recess in said arm.

21. The bit of claim 19, wherein a finger extends into said groove for a length of more than 0.100 inches.

22. A method for downhole rotary drilling, comprising the use of a bit according to claim 19.

23. A drill rig, comprising a bit according to claim 19.

24. A bit for downhole rotary drilling, comprising:

a body supporting at least one arm/spindle structure;

a cutting element mounted on said arm/spindle structure through one or more rotary bearings;

and a rotary seal, contacting both said cutting element and said spindle to exclude cuttings-laden fluid from said bearings;

wherein said cutting element and said arm/spindle structure jointly define a crack which is interposed between said rotary seal and the cuttings-laden fluid, said cutting element being shaped to provide a rimmed groove to said crack; and wherein both said cutting element and said arm/spindle structure are relieved where said crack opens onto the cuttings-laden fluid, to expose drilling fluid over a cross-sectional angle of more than 135 degrees.

25. The bit of claim 24, wherein a finger extends into said crack for a length of more than 0.100 inches.

26. A method for downhole rotary drilling, comprising the use of a bit according to claim 24.

27. A drill rig, comprising a bit according to claim 24.

28. A bit for downhole rotary drilling, comprising:

a body supporting at least one arm/spindle structure;

a cutting element mounted on said arm/spindle structure through one or more rotary bearings; and a rotary seal, contacting both said cutting element and said spindle to exclude cuttings-laden fluid from said bearings;

wherein said cutting element and said arm/spindle structure jointly define a crack which is interposed between said rotary seal and the cuttings-laden fluid, said cutting element being shaped to provide a rimmed groove to said crack; and wherein both said cutting element and said arm/spindle structure are relieved, where said crack opens onto the cuttings-laden fluid, to expose drilling fluid over a solid angle of more than 4 steradians.

29. The bit of claim 28, wherein a finger extends into said crack for a length of more than 0.100 inches.

30. A method for downhole rotary drilling, comprising the use of a bit according to claim 28.

31. A drill rig, comprising a bit according to claim 28.

* * * * *